US008512826B2

(12) United States Patent
Sturme et al.

(10) Patent No.: US 8,512,826 B2
(45) Date of Patent: Aug. 20, 2013

(54) RECORDING SHEET FOR INK-JET PRINTING

(75) Inventors: Rudolf A. H. M. Sturme, Maasbree (NL); Dorothea M. H. Wijnhoven, DT Horst (NL); Kolja Adamczyk, AN Molenhoek (NL); James A. Foley, Wellesley, MA (US); Khizyr Kharunovich Khoultchaev, Branford, CT (US)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/100,487

(22) Filed: May 4, 2011

(65) Prior Publication Data

US 2011/0254908 A1 Oct. 20, 2011

Related U.S. Application Data

(63) Continuation of application No. PCT/EP2009/063895, filed on Oct. 22, 2009.

(60) Provisional application No. 61/111,520, filed on Nov. 5, 2008.

(51) Int. Cl.

| | |
|---|---|
| ***B41M 5/00*** | (2006.01) |
| ***D06P 5/30*** | (2006.01) |
| ***B41M 5/52*** | (2006.01) |
| ***B41M 5/50*** | (2006.01) |

(52) U.S. Cl.

CPC ..... *D06P 5/30* (2013.01); *B41M 5/5218* (2013.01); *B41M 5/508* (2013.01); *B41M 5/52* (2013.01); *B41M 5/506* (2013.01); *B41M 5/5254* (2013.01)

USPC ..... 428/32.16; 428/32.21; 428/32.24; 428/32.25; 428/32.26; 428/32.29; 428/32.34; 428/32.35

(58) Field of Classification Search

CPC ..... D06P 5/30; B41M 5/5218; B41M 5/508; B41M 5/52; B41M 5/506; B41M 5/5254

USPC ..... 428/32.16, 32.21, 32.24, 32.25, 428/32.26, 32.29, 32.34, 32.35

See application file for complete search history.

(56) References Cited

U.S. PATENT DOCUMENTS 4,686,118 A * 8/1987 Arai et al. ..... 428/32.14
6,086,985 A * 7/2000 Shaw-Klein et al. ..... 428/304.4

(Continued)

FOREIGN PATENT DOCUMENTS

EP 0962330 A2 12/1999
EP 1080936 A2 3/2001

(Continued)

OTHER PUBLICATIONS

International Search Report for PCT/EP2009/063895, mailed on Jan. 19, 2010.

*Primary Examiner* — Betelhem Shewareged
(74) *Attorney, Agent, or Firm* — Birch, Stewart, Kolasch & Birch, LLP

(57) ABSTRACT

A recording sheet for ink-jet printing includes a supporting substrate, at least one microporous ink-receptive coating overlying a front surface of said supporting substrate and at least one protective overcoating overlying said microporous coating. The protective overcoating includes at least one compound selected from the group consisting of polysaccharides and polyacrylamides, and fluoropolymer particles. The diameter of the fluoropolymer particles is between about 0.5 and 3 micrometers.

18 Claims, 1 Drawing Sheet

(56) References Cited

U.S. PATENT DOCUMENTS

| | | | | |
|---|---|---|---|---|
| 6,387,473 | B1 * | 5/2002 | Sismondi et al. | 428/32.34 |
| 6,682,587 | B2 | 1/2004 | Hendricks et al. | |
| 6,863,939 | B2 * | 3/2005 | Laney et al. | 428/32.16 |
| 2002/0064633 | A1 * | 5/2002 | Wakata et al. | 428/195 |
| 2004/0027436 | A1 * | 2/2004 | Kaieda et al. | 347/103 |
| 2006/0044383 | A1 * | 3/2006 | Romano, Jr. | 347/105 |
| 2006/0068133 | A1 | 3/2006 | Khoultchaev et al. | |
| 2007/0196595 | A1 | 8/2007 | Martin | |
| 2008/0057232 | A1 * | 3/2008 | Leon et al. | 428/32.24 |
| 2009/0130309 | A1 * | 5/2009 | Kawakami et al. | 427/261 |

FOREIGN PATENT DOCUMENTS

| | | | |
|---|---|---|---|
| EP | 1407891 | A1 | 4/2004 |
| EP | 1806236 | A1 | 7/2007 |

* cited by examiner

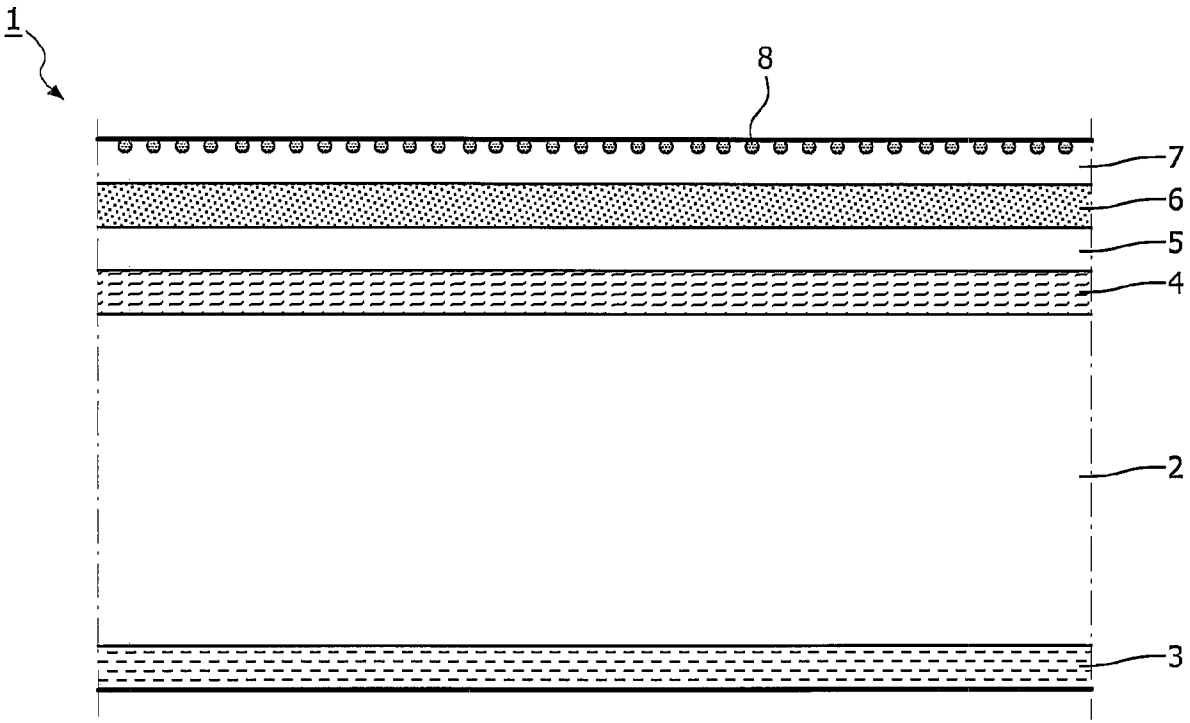
1
8
7
6
5
4
2
3

RECORDING SHEET FOR INK-JET PRINTING

CROSS-REFERENCE TO RELATED APPLICATIONS

This application is a Continuation of copending PCT International Application No. PCT/EP2009/063895 filed on Oct. 22, 2009, which designated the United States, and on which priority is claimed under 35 U.S.C. §120. This application also claims priority under 35 U.S.C. §119(e) on U.S. Provisional Application No. 61/111,520, filed on Nov. 5, 2008. The entire contents of each of the above documents is hereby incorporated by reference into the present application.

BACKGROUND OF THE INVENTION

1. Field of the Invention

The present invention relates to a recording sheet for ink-jet printing.

2. Description of Background Art

An ink jet printer is conventionally used for recording desired characters and images on a recording sheet, such as a paper sheet or any other medium, by directly placing ink droplets jetted from a print head. The printing speed of modern ink jet printers is ever increasing for economical reasons. Recording sheets suitable for these printers therefore need to absorb the inks very quickly. However, in the known ink jet printer, each jetted ink droplet is directly placed on the recording paper, so that a print quality or time for drying a printed image are changed according to the kind of the recording paper. That is, there is a problem in that the print quality is remarkably deteriorated when it is printed on low quality recording paper, the printed image being blurred and illegible. In order to solve such a problem, it has been proposed to use ink of a hot melt type as ink for an ink jet printer. The characteristic of these hot melt inks is that they are solid at room temperature, they are liquefied by heating for application, and they are resolidified by cooling on the printed media. Various compositions are known for a hot melt ink. Some of the known hot melt inks of the present invention contain crystalline materials. An example of a known hot melt ink comprising a crystalline fraction is disclosed in U.S. Pat. No 6,682,587. During the ink-jet process the hot melt ink is applied onto an ink-jet imaging medium (recording sheet). The recording sheet generally comprises a substrate and an ink-receptive layer formed on an imaging surface of the substrate. This substrate is then coated with specially formulated ink-receptive compositions that are capable of receiving and holding the aqueous-based inks effectively so as to generate a quality printed image. An example of a known ink-jet recording sheet is disclosed in U.S. Application Publication No. 2006/0068133. It has, however, been found that in case a crystalline fraction based hot melt is applied onto the known recording sheet, the known recording sheet will suffer from post-crystallization of the crystalline compound of the hot melt ink at the surface of the sheet. This results in a poor print quality after a few days or weeks, far shorter than the desired life expectancy. The post-crystallization process can be very fast, if the sheet surface is touched with fingers or scuffed with cotton gloves. The only known solution so far to counteract this problem is to apply a protective covering directly after printing. However, this additional step involves extra handling and costs.

SUMMARY OF THE INVENTION

It is an object of the present invention to provide an improved ink-jet recording sheet, in which the effect of post-crystallization can be countered more efficiently.

To this end, the present invention is directed to a recording sheet for ink-jet printing, comprising: a supporting substrate; at least one microporous ink-receptive coating overlying a front surface of said supporting substrate; and at least one protective overcoating overlying said microporous coating, said at least one protective overcoating comprising: at least one compound selected from the group consisting of polysaccharides and polyacrylamides; and polytetrafluoroethylene particles, wherein the diameter of the polytetrafluoroethylene particles is between about 0.5 and 3 micrometers.

It has been found that by applying an overcoating comprising at least one polysaccharide and/or at least one polyacrylamide, the effect of post-crystallization of a crystalline fraction of a hot melt ink can be reduced significantly as a result of which the quality and gloss of an image printed onto the sheet can be preserved in a relatively durable manner. The overcoating is, however, prima facie permeable for liquefied hot melt ink to allow substantially unhindered migration of the liquid ink through the overcoating towards the ink-receptive microporous coating. It is expected that hydrogen bridges formed between the components of the microporous coating and the polysaccharide(s) and/or polyacrylamides(s) of the overcoating impede counter-migration of the crystalline fraction back to the upper surface of the sheet, as a result of which post-crystallization at the sheet surface can be counteracted. A further advantage of the application of the abovementioned protective overcoating is that this coating provides a resistance to ozone fading of the printed image on the sheet. By means of the protective overcoating, the sheet according to the present invention is capable of recording images that will resist fading due to ozone exposure. The ozone-protective coating may slow the photo-oxidation process, which is one of the primary causes for ozone-fading problems.

The protective overcoating preferably comprises at least one guar gum, more preferably, at least one jaguar gum, and particularly preferably Jaguar Gum 8600 (carboxymethyl hydroxypropyl guar), a product of Hi-Tek Polymers Inc. Guar gum is a natural non-ionic polysaccharide derived from the seeds of Cymompsis tetraganolobus (family: Leguminaceae). Guar gum has the capability to swell in polar media, forming viscous colloidal dispersions or sols. Besides the aforementioned formation of hydrogen bridges, this gelling property may further contribute to counteract post-crystallization of a crystalline compound of a hot melt ink at the sheet surface and hence to the preservation of the gloss of the image printed onto the recording sheet. Another suitable polysaccharide which can be employed is carageenan. Alternatively, also cationic and anionic polyacrylamides may be used.

In a preferred embodiment, the protective overcoating further comprises at least one polydiallyldimethylammonium chloride (polyDADMAC), more preferably Glascol F207, a product from Ciba. Glascol F207 is a low molecular weight, high charge density cationic polyelectrolyte, comprising an aqueous solution of a poly(dimethyl diallylammonium chloride) homopolymer. PolyDADMAC, and in particular Glascol F207, may bind the (cationic) black dye being used in hot melt ink. It has moreover been found that the polyDADMAC, in particular Glascol F207, has a beneficial effect on the prevention of post-crystallization. The preferred molecular weight of the polyDADMAC applied is determined both by the density of the black dye in the hot melt and by the desired absorbing capacity of the overcoating as such.

In another preferred embodiment, the protective overcoating further comprises at least one softening agent, more preferably glycerine. Glycerine lowers the brittleness of the microporous coating and of the image printed onto the recording sheet according to the present invention. Glycerine may moreover be incorporated in other layers of the recording sheet, such as e.g. the microporous coating.

The protective overcoating preferably further comprises a fluoropolymer. For example, Teflon, polytetrafluoroethylene particles. It has been found that the incorporation of Teflon particles, a fluoropolymer from the DuPont company, in the overcoating will suppress the negative effect of both finger marks and scuffing causing post-crystallization at the sheet surface. The expression scuffing is used for wiping the sheet surface with considerable amount of friction as will happen when using hand gloves. A further advantage of the application of Teflon particles is that Teflon restricts coalescene of the ink on the sheet surface. Coalescence or "ink mottling" is the effect that the ink is not evenly distributed over the recording sheet due to high surface tension values of the ink, which may result in poorly-defined graphic images on the sheet. By using the Teflon particles this adverse effect can be prevented, or at least counteracted, resulting in a durable and improved image quality. To establish the aforementioned effects, in a preferred embodiment, the diameter of the Teflon particles is situated between 0.5 and 3 micrometers. The concentration of the Teflon particles in the overcoating is preferably situated between 0.05 and 4 percentage by mass of the total mass of the coating fluid. A higher percentage will commonly lead to haze and hence to a reduced image gloss. It is explicitly noted that the Teflon particles may also be applied in the overcoating without the presence of a polysaccharide or a polyacrylamide in the overcoating in order to reduce the post-crystallization effect due to physical contact (e.g. scuffing) with the recording sheet. As an alternative for Teflon particles, also polyethylene (such as Chemcor 392 C30) and/or polypropylene particles (such as Chemcor 950 C25 and Chemcor 43 C30) could be applied.

The grammage (thickness) of the overcoating is preferably between 2 and 10 g/m$^2$ (gsm), and more preferably, between 3 and 8 g/m$^2$. A grammage falling within at least one of these defined ranges commonly leads to a preferred balance for providing sufficient protection against post-crystallization, wherein limitation of ink migration through the overcoating is kept as low as possible. The grammage of the microporous coating is between 8 g/m$^2$ and 50 g/m$^2$, more preferably between 40 g/m$^2$ and 50 g/m$^2$.

The microporous ink-receptive layer preferably comprises a porous dispersion of particles and a polymer binder, said layer being adapted to quickly absorb ink, but exhibits improved color brilliance, sharpness and fidelity. The particle and polymer binder materials provide the ink-receptive layer with a porous morphology that enables the ink-receptive layer to absorb the ink vehicle, such as water, relatively quickly. The particles in the composition can form interstitial pores or voids in the ink-receptive coating so that the coating can absorb the ink by a wicking or capillary action. As ink is impinged onto the coating, it enters these interstitial voids and is absorbed. The dyes and/or pigments of the ink can be retained in the microporous layer. Some of the ink vehicle may pass through the permeable layer into the substrate, provided that the substrate is arranged to absorb said ink vehicle.

This effectively increases the ink vehicle absorptivity of the microporous layer without increasing or requiring an increase in its thickness. The blend of particle and polymer binders in the ink-receptive layer significantly contributes to the relatively fast ink-drying times of the media.

In a preferred embodiment, the sheet comprises an intermediate coating enclosed by the substrate and the microporous coating, said intermediate coating comprising at least one borate and at least one copolymer, said copolymer comprising at least one urethane. The urethane based copolymer is also referred to as a polyurethane binder. The nonionic waterborne polyurethane binder is an aliphatic polyether waterborne urethane polymer having a relatively high moisture vapour transmission rate (MVTR). More preferably, as the urethane copolymer at least one Permax polymer, a product from Noveon, is used. The urethane copolymer is primarily used to counteract post-crystallization of the crystalline component of the hot melt ink. To this end, preferably Permax 240 (commercially not available) is used. The intermediate coating may further be applied to realize an improved adhesion between the substrate and the microporous coating. To this end, preferably Permax 200 (commercially available) is used. In a particular preferred embodiment, a mix of Permax 200 and Permax 240 is used to have benefit of both effects set out above. The interaction between the two different Permax grades and the crystalline compound of the hot melt ink have been studied using differential scanning calorimetry (DSC) analysis. It is found that approximately 10 percentage by mass of crystalline compound can be 'solvated' by Permax, independent of the type. The 'solvated' crystalline compound is in a amorphous state, and as such does not explain why Permax 240 has a more positive result on the post-crystallization than Permax 200.

Both Permax grades show two distinct glass transition temperatures. The more 'rubbery' Permax 240 has the lowest glass transition temperature. The reason as to why Permax 240 differs from Permax 200 may be related towards the differences in glass transition temperature. This again may result in differences in diffusion of amorphous crystalline compound within the Permax system. Although Permax 200, just like Permax 240, may act as a sink, as soon as it is saturated by the crystalline compound, it cannot continue to do so. Permax 240 may be able to act as a drain for the crystalline compound from the microporous coating due to a combination of it's solvation capacity together with it's role as a gateway to the substrate. It is believed that the polymer will become more effective in case the operational temperature exceeds the glass transition temperature of the polymer used. The at least one borate provides better drying control for the microporous coating, wherein it is assumed that the borate provides gelling and cross linking of polyvinyl alcohol in the microporous coating. The intermediate coating may be adapted to absorb ink. However, it would also be conceivable for one having ordinary skill in the art to apply a non-permeable intermediate coating.

In another preferred embodiment of the sheet according to the present invention, the sheet comprises a smoothening coating for smoothening the substrate prior to applying the other coatings, said smoothening coating being enclosed by the substrate and said other coatings. By smoothening the substrate prior to application of the other coatings, also a relatively smooth front surface of the recording sheet can be obtained, resulting in a high gloss images. The smoothening coating can also form a barrier both for hot melt ink and the ink vehicle. However, it would also be imaginable to apply a smoothening coating which is permeable for the hot melt ink, or at least a part thereof. In this manner, the ink vehicle, in particular the crystalline compound, of the hot melt ink may leak through the barrier layer and may be absorbed by the substrate resulting in a reduced risk of post-crystallization of the crystalline compound (encapsulated within the substrate) and moreover to an improved ink storage capacity of the sheet according to the present invention. It is therefore explicitly noted that the leaky barrier layer may also be applied in the sheet according to the present invention without the additional presence of an overcoating in order to reduce the post-crystallization effect due to leakage of the crystalline compound through the barrier layer and to allow the substrate to absorb said crystalline compound. In particular, acrylate coatings with low level of crosslinking and/or coatings obtained with low functionality soft urethanes monomers are permeable for the hot melt ink and are therefore suitable to act as a leaky barrier layer. The smoothening coating is preferably an ultraviolet (UV) cured oligomer or monomer, preferably an acrylate based coating. In a particular embodiment, the smoothening coating is enclosed by the substrate and the intermediate coating.

The sheet preferably further comprises a polymeric curl-controlling coating overlying a back surface of the substrate to help reduce curling and cockling of the recording sheet. In addition, the back surface of the substrate may be coated with a polymeric coating that further helps prevent moisture from penetrating into the back surface of the substrate. The polymeric coating on the back surface of the substrate enhances the substrate's dimensional stability and helps minimize curling, cockling, and other defects. Applying the back coating also provides a way to adjust the back surface-friction of the sheet, which can be important in assisting the feeding of the imaging sheet into the ink-jet printer, and typically also provides a way to control the anti-static properties to the ink-jet recording sheet.

The substrate may be made of various materials, though is preferably made of at least one material selected from the group consisting of papers, polymers, textiles, and metals. Dependent on the selected material, the substrate will have either an absorbent property (e.g. in case the substrate is a paper substrate) or an impermeable property (e.g. in case the substrate is a metal substrate).

The present invention also relates to the use of a protective overcoating in a sheet for ink-jet printing, in particular a sheet according to the present invention, said protective overcoating comprising at least one compound selected from the group consisting of polysaccharides and polyacrylamides. Advantages of the application of such a protective overcoating have already been elucidated above in a comprehensive manner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will now be explained further with reference to the accompanying drawings, wherein:

FIG. 1 is a schematic cross section of a recording sheet according to the present invention.

DETAILED DESCRIPTION OF THE INVENTION

FIG. 1 is a schematic cross section of an image receiving sheet 1 for ink-jet printing according to the present invention. The sheet 1 is adapted to prevent, or at least to counteract, post-crystallization of a crystalline compound of a hot melt ink at an upper surface of the sheet. The sheet 1 comprises a paper substrate 2, at a back surface of which substrate 2 a back coating 3 is applied to prevent curling of the sheet 1. A front surface of the substrate 2 is successively provided with a smoothening coating 4 (barrier coating), an intercoat 5, a microporous ink-receptive coating 6, and a protective overcoating 7. The different coatings 3, 4, 5 and 6 of the sheet 1 will be described in more detail hereinafter.

A. The overcoating:

The overcoating 7 comprises Jaguar Gum 8600 (a polysaccharide) to prevent (spontaneous) post-crystallization of a crystalline compound of the hot melt ink at a front (upper) surface of the sheet 1. The overcoating 7 moreover comprises Glascol F207 (a polyDADMAC) to bind the black dye of the hot melt ink and to further counteract post-crystallization of the crystalline compound of the hot melt ink. Glycerin has been added to the overcoating 7 to soften the microporous coating 6 and to prevent generation of cracks within said microporous coating 6. The overcoating 7 further comprises Fluoro AQ50 particles 8 (Teflon particles) to prevent post-crystallization of said crystalline compound at a front (upper) surface of the sheet 1 due to physical contact with this front surface of the sheet 1. The grammage of the overcoating 7 is about 5 gsm in this embodiment. The exact composition of the overcoating 7 is given in Table 1.

TABLE 1

| Material | % Solids in Coating Fluid | GSM coated on substrate |
|---|---|---|
| Jaguar-8600 | 0.08 | 0.022 |
| Glascol F207 | 14.0 | 3.88 |
| Glycerin | 4.0 | 1.10 |
| Fluoro AQ50 | 0.10 | 0.027 |

B. The Microporous Ink-Receptive Coating:

Generally, the microporous ink-receptive coating 6 comprises a dispersion of particles (pigment) and a polymer binder. The particle and polymer binder materials provide the ink-receptive layer with a porous morphology that enables the ink-receptive layer to better absorb the ink vehicle. The particles in the composition form interstitial pores or voids in the ink-receptive coating 6 so that the coating 6 can absorb the ink by a wicking or capillary action. As ink is impinged onto the coating, it enters these interstitial voids and is absorbed. The dyes and/or pigments of the ink can be retained in the microporous coating 6. The blend of particle and polymer binders in the ink-receptive coating 6 significantly contributes to the relatively fast ink-drying times of the media. The particles can comprise inorganic or organic particles. Suitable inorganic particles that can be used in the ink-receptive layer include, for example, those selected from the group consisting of kaolin, talc, clay, calcium sulfate, calcium carbonate, alumina, aluminum silicate, colloidal alumina, silica, colloidal silica, lithopone, zeolite, hydrated halloysite, magnesium hydroxide, magnesium carbonate, barium sulfate, titanium dioxide, zinc oxide, zinc sulfate, and zinc carbonate particles. These particles can be in the form of aerogels and/or xerogels as well as amorphous or crystalline materials. Suitable organic polymer particles include, for example, those selected from the group consisting of polyethylene, polypropylene, polyacrylate, polymethacrylate, polystyrene, polyamide, polyurethane, fluoropolymer, and polyester particles. The particles, themselves, can have a high surface area and porous structure. Such porous particles can absorb the aqueous ink vehicle themselves in addition to forming open voids in the ink-receptive layer. In this specific exemplary embodiment the Disperal HP 18 is used as an inorganic compound and Poval 245 (a polyvinylalcohol), a product from from Sasol, is used as a binder due to its favorable rheologic properties in a fluid state. The grammage of the microporous coating 6 is about 45 gsm in this embodiment. The exact composition of the microporous coating 6 is given in Table 2.

TABLE 2

| Material | % Solids in Coating Fluid | GSM coated on substrate |
|---|---|---|
| Disperal HP 18 | 24.7 | 41.4 |
| Poval 245 | 2.15 | 3.6 |

C. The Intercoat:

In this exemplary embodiment the intercoat 5 (intermediate coating) comprises a mix of two urethane copolymers, Permax 200 (commercially available) and Permax 240 (commercially not available). Permax 200 provides a solid adhesion between the smoothening coating 4 and the microporous coating 6, while Permax 240 further prevents post-crystallization of the crystalline compound of the hot melt ink to further sustain the image quality. Potassium borate acts as a binder which provides an improved drying control for the microporous coating 6. It is assumed that the borate provides gelling and crosslinking of the polyvinylalcohol (Poval 245) of the microporous coating 6. The grammage of the intercoat 5 is about 6 gsm in this embodiment. The exact composition of the intercoat 5 is given in Table 3.

TABLE 3

| Material | % Solids in Coating Fluid | GSM coated on substrate |
|---|---|---|
| Permax-200 | 11.9 | 2.25 |
| Permax-240 | 16.6 | 3.13 |
| Potassium Borate | 3.3 | 0.62 |

D. The Smoothening Coating

The smoothening coating 4 (barrier coating) overlies the front surface of the substrate 2 and enables the sheet 1 to achieve a glossy surface finish without a very thick microporous coating 6. The smoothening coating 4 may be permeable or impermeable for ink applied onto the sheet 1. A preferred way to produce the smoothening coating 4 is to apply a radiation curable coating, preferably acrylate-based, then radiation cure the radiation curable coating wholly or partially. The preferred form of radiation for this is ultraviolet (UV) light curing. However, other radiation curing technologies, such as x-ray or electron-beam curing, as well as other methods of forming permeable coatings with the appropriate permeability also can be used within the scope of the present invention. During manufacture of the media, a radiation-curable composition is applied to the substrate and, thereafter, radiation from an electron beam, x-ray source or ultraviolet (UV) light source is used to cure this radiation-curable coating 4. In ultraviolet (UV) light radiation, photoinitiators (photosensitizers) typically are used to initiate the polymerization. In the present invention, the radiation-cured smoothening coating 4 preferably is produced from a curable coating that comprises acrylate-based oligomers or monomers or a combination of them, and it can comprise urethane-modified acrylic monomers, or hydroxyl-terminated urethane oligomers, for example. Preferably, in the present invention, UV light radiation is used to cure the coating, and in this regard the coating formulation preferably includes a photoinitiator. Typically, the UV light has a wavelength in the range of about 150 nm to about 400 nm. Commercial UV light curing equipment may be used. Such equipment typically includes an UV light source (e.g., a tubular glass lamp), reflectors to focus or diffuse the UV light, and a cooling system to remove heat from the lamp area. After the curing steps, the UV-cured smoothening coating 4 may be treated with corona discharge to improve its adhesion to the microporous ink-receptive coating 6 to be applied over the smoothening coating 4. The smoothening coating 4 may also contain additives such as inhibitors, surfactants, waxes, cure accelerators, defoaming agents, pigments, dispersing agents, optical brighteners, UV light stabilizers (blockers), UV absorbers, adhesion promoters, and the like. In the manufacturing process, one or more UV-curable oligomers and or monomers are blended together with a photoinitiator and any additives. The mixture may be heated to reduce its viscosity. The coating formulation may be applied to the substrate 2 by any suitable method. Suitable methods for application of the monomers and/or oligomers (leading to smoothening coating 4) to the paper substrate 2 include, for example, Meyer-rod, roller, blade, wire bar, dip, solution extrusion, air-knife, curtain, slide, doctor-knife, and gravure methods. The radiation-cured smoothening coating 4 preferably has a grammage of between 2 and 10 gsm, and most preferably a grammage of substantially 5 gsm. In case the smoothening coating 4 also acts as a leaky barrier coating, preferably a composition of CN9002 (an aliphatic urethane acrylate), CN929 (a trifunctional urethane acrylate) in a ratio 4:1 is used together with about 5% of photoinitiator Esacure KTO 46. The grammage of this leaky barrier coating is preferably between 4 and 8 gsm.

E. The Back Coating:

The back coating 3 is a polymeric coating that further helps prevent moisture from penetrating into the back surface of the substrate 2. The polymeric back coating 3 on the back surface of the substrate enhances the substrate's dimensional stability and helps minimize curling, cockling, and other defects. Applying the back coating 3 also provides a way to adjust the back surface-friction of the medium, which can be important in assisting the feeding of the imaging medium into the ink-jet printer, and typically also provides a way to control the anti-static properties to the ink-jet medium. The back coating 3 comprises a surfactant Surfynol PG50, a product from Air-products and Chem., a filler Sylysia 270, a product from Fuji Sylysia Chemical Ltd., and two acrylic polymers, Joncryl 624 (having a low glass transition temperature) and Joncryl HPD71 (having a high glass transition temperature). The grammage of the back coating 3 is about 12 gsm in this embodiment. The exact composition of the back coating 3 is given in Table 4.

TABLE 4

| Material | % Solids in Coating Fluid | GSM coated on substrate |
|---|---|---|
| Surfynol PG50 | 0.02 | (Additive for foam control) |
| Sylysia 270 | 7.50 | 3.3 |
| Joncryl 624 | 7.50 | 3.3 |
| Joncryl HPD71 | 12.38 | 5.4 |

It should be noted that the above-mentioned embodiments illustrate rather than limit the present invention, and that those having ordinary skill in the art will be able to design many alternative embodiments without departing from the scope of the appended claims. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A recording sheet for ink-jet printing, comprising:

a supporting substrate;

at least one microporous ink-receptive coating overlying a front surface of said supporting substrate; and at least one protective overcoating overlying said microporous coating, said at least one protective overcoating comprising:

at least one compound selected from the group consisting of polysaccharides and polyacrylamides; and fluoropolymer particles, wherein the diameter of the fluoropolymer particles is between about 0.5 and 3 micrometers, wherein the at least one protective overcoating is permeable to liquefied hot melt ink.

2. The recording sheet for ink-jet printing according to claim 1, wherein the at least one protective overcoating comprises at least one guar gum.

3. The recording sheet for ink-jet printing according to claim 2, wherein the at least one protective overcoating comprises at least one jaguar gum.

4. The recording sheet for ink-jet printing according to claim 1, wherein the at least one protective overcoating further comprises at least one polydiallyldimethylammonium chloride.

5. The recording sheet for ink-jet printing according to claim 1, wherein the at least one protective overcoating further comprises at least one softening agent.

6. The recording sheet for ink-jet printing according to claim 5, wherein the at least one softening agent comprises glycerine.

7. The recording sheet for ink-jet printing according to claim 1, wherein the grammage of the at least one protective overcoating is between 2 and 10 $g/m^2$.

8. The recording sheet for ink-jet printing according to claim 1, wherein the grammage of the at least one protective overcoating is between 3 and 8 $g/m^2$.

9. The recording sheet for ink-jet printing according to claim 1, further comprising an intermediate coating enclosed by the supporting substrate and the at least one microporous ink-receptive coating, said intermediate coating comprising at least one borate and at least one copolymer, said copolymer comprising at least one urethane.

10. The recording sheet for ink-jet printing according to claim 1, further comprising a smoothening coating for smoothening the supporting substrate prior to applying the at least one microporous ink-receptive coating, said smoothening coating being enclosed by the supporting substrate and the at least one microporous ink-receptive coating.

11. The recording sheet for ink-jet printing according to claim 9, further comprising a smoothening coating for smoothening the supporting substrate prior to applying the intermediate coating, said smoothening coating being enclosed by the supporting substrate and the intermediate coating.

12. The recording sheet for ink-jet printing according to claim 10, wherein the smoothening coating is substantially impermeable to moisture.

13. The recording sheet for ink-jet printing according to claim 11, wherein the smoothening coating is substantially impermeable to moisture.

14. The recording sheet for ink-jet printing according to claim 1, wherein the supporting substrate is made of at least one material selected from the group consisting of papers, polymers, textiles, and metals.

15. The recording sheet for ink-jet printing according to claim 1, wherein the fluoropolymer is polytetrafluoroethylene.

16. A method of making a recording sheet for ink-jet printing, comprising the step of using the at least one protective overcoating according to claim 1.

17. A method of using the recording sheet for ink-jet printing according to claim 1, in an ink-jet printing process, said method comprising the steps of:

applying a hot melt ink, the hot melt ink being an ink that is solid at room temperature, that is liquefied by heating for application and that is resolidified by cooling on the recording sheet.

18. A recording sheet for ink-jet printing, comprising:

a supporting substrate;

at least one microporous ink-receptive coating overlying a front surface of the supporting substrate; and at least one protective overcoating overlying the microporous coating, the at least one protective overcoating comprising:

at least one compound selected from the group consisting of polysaccharides and polyacrylamides; and fluoropolymer particles, wherein the fluropolymer particles are present only at an outer surface of the at least one protective overcoating, wherein the at least one protective overcoating is permeable to liquefied hot melt ink.

* * * * *